US010988907B1

(12) United States Patent
Lan

(10) Patent No.: US 10,988,907 B1
(45) Date of Patent: Apr. 27, 2021

(54) SINKING APPARATUS FOR SINKING CONCRETE SHAFT

(71) Applicant: ICIAN ENGINEERING CONTRACTORS CO., LTD., New Taipei (TW)

(72) Inventor: Ming-Yang Lan, New Taipei (TW)

(73) Assignee: ICIAN ENGINEERING CONTRACTORS CO., LTD., New Taipei (TW)

( * ) Notice: Subject to any disclaimer, the term of this patent is extended or adjusted under 35 U.S.C. 154(b) by 0 days.

(21) Appl. No.: 17/003,944

(22) Filed: Aug. 26, 2020

(51) Int. Cl.
*E02D 7/00* (2006.01)
*E02D 5/30* (2006.01)

(52) U.S. Cl.
CPC ..... *E02D 7/00* (2013.01); *E02D 5/30* (2013.01); *E02D 2200/1685* (2013.01); *E02D 2300/002* (2013.01); *E02D 2300/0029* (2013.01)

(58) Field of Classification Search
CPC .... E02D 7/20; E02D 7/24; E02D 7/26; E02D 7/28; E02D 13/04
See application file for complete search history.

(56) References Cited

U.S. PATENT DOCUMENTS 1,173,355 A * 2/1916 Jones ..... E02D 7/24 405/248
3,063,500 A * 11/1962 Logan ..... E21B 33/037 166/351
3,592,263 A * 7/1971 Nelson ..... E21B 33/037 166/356
3,783,626 A * 1/1974 Hansen ..... E02F 9/06 405/226
3,820,346 A * 6/1974 Wisotsky ..... E02D 7/00 405/228
3,842,917 A * 10/1974 Wisotsky ..... E02D 7/28 173/90
3,859,798 A * 1/1975 Terashima ..... E02D 13/04 405/50
3,916,634 A * 11/1975 Woodruff ..... E02F 3/963 405/248
4,318,641 A * 3/1982 Hogervorst ..... B63B 21/27 405/224
4,335,740 A * 6/1982 Boley ..... E02D 29/12 137/364
4,558,744 A * 12/1985 Gibb ..... E21B 7/185 166/335
4,591,296 A * 5/1986 Henderson, Jr. ..... E02D 13/04 166/339

(Continued)

FOREIGN PATENT DOCUMENTS

CN 204899978 U 12/2015

*Primary Examiner* — Benjamin F Fiorello
(74) *Attorney, Agent, or Firm* — Hamre, Schumann, Mueller & Larson, P.C.

(57) ABSTRACT

A sinking apparatus for sinking a concrete shaft includes a water tank, a valve assembly, a communication pipe, and a pumping device. The water tank is disposed on an upper surrounding edge of the concrete shaft, and has a water outlet port. The valve assembly includes a valve gate which is operable to open and close the water outlet port. The pumping device is disposed to permit water inside a central hollow portion of the concrete shaft to be pumped into a water accommodation space of the water tank through the communication pipe.

18 Claims, 11 Drawing Sheets

(56) References Cited

U.S. PATENT DOCUMENTS

| | | | | |
|---|---|---|---|---|
| 4,742,876 | A * | 5/1988 | Barthelemy | E02D 5/38 175/189 |
| 5,002,434 | A * | 3/1991 | Massoudi | E02D 23/08 405/226 |
| 5,951,207 | A * | 9/1999 | Chen | E02D 7/02 405/228 |
| 10,364,609 | B2 * | 7/2019 | Deul | E21B 7/136 |
| 2015/0197907 | A1 * | 7/2015 | Aurora | E21B 7/12 405/211 |

* cited by examiner

SINKING APPARATUS FOR SINKING CONCRETE SHAFT

FIELD

The disclosure relates to a sinking apparatus, more particularly to a sinking apparatus for sinking a concrete shaft.

BACKGROUND

A concrete shaft, after being sunk into the ground, may function as a bridge pier or a base of a construction element. The concrete shaft may be sunk into the ground using excavation techniques, and so on. However, after the concrete shaft has been sunk to a certain depth, groundwater may gush out, which is adverse for further sinking of the concrete shaft.

SUMMARY

Therefore, an object of the disclosure is to provide a sinking apparatus for sinking a concrete shaft which may overcome the drawback of the prior art.

According to the disclosure, a sinking apparatus for sinking a concrete shaft includes a water tank, a valve assembly, a communication pipe, and a pumping device. The water tank is for being disposed on an upper surrounding edge of the concrete shaft, and includes a base wall and a surrounding wall. The base wall has a water outlet port, and defines a central axis in an upright direction. The surrounding wall extends upwardly from a periphery of the base wall to define a water accommodation space. The valve assembly is mounted to the base wall, and includes a valve gate which is operable to open and close the water outlet port. The communication pipe has an upper segment and a lower segment. The upper segment is coupled to the water tank to permit the communication pipe to be in fluid communication with the water accommodation space. The lower segment is for being disposed into a central hollow portion of the concrete shaft. The pumping device is disposed to permit water inside the central hollow portion of the concrete shaft to be pumped into the water accommodation space through the communication pipe.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Figure 1:
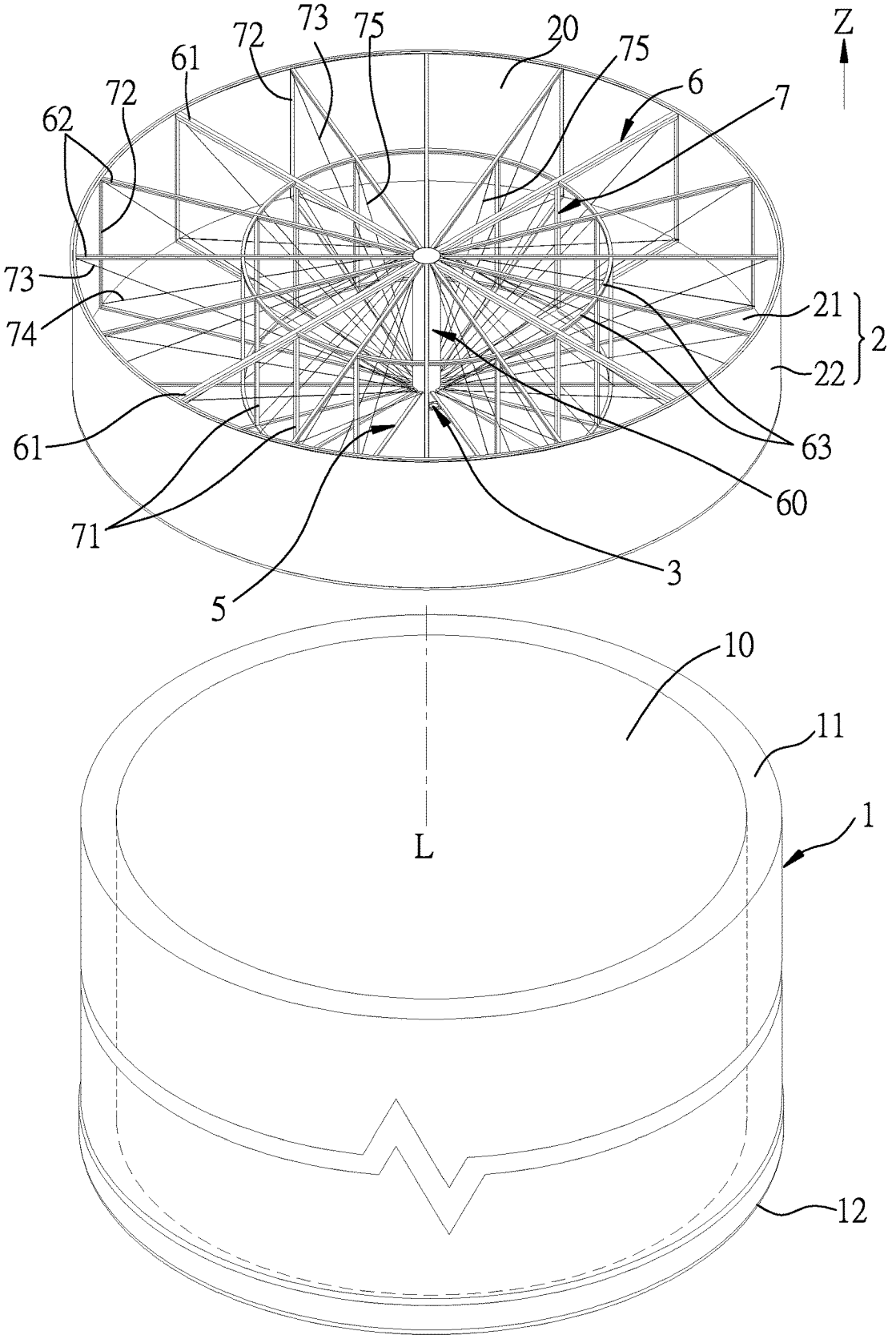
FIG. 1 is a perspective view illustrating a concrete shaft and a sinking apparatus according to an embodiment of the disclosure in which some elements are omitted.
Figure 10:
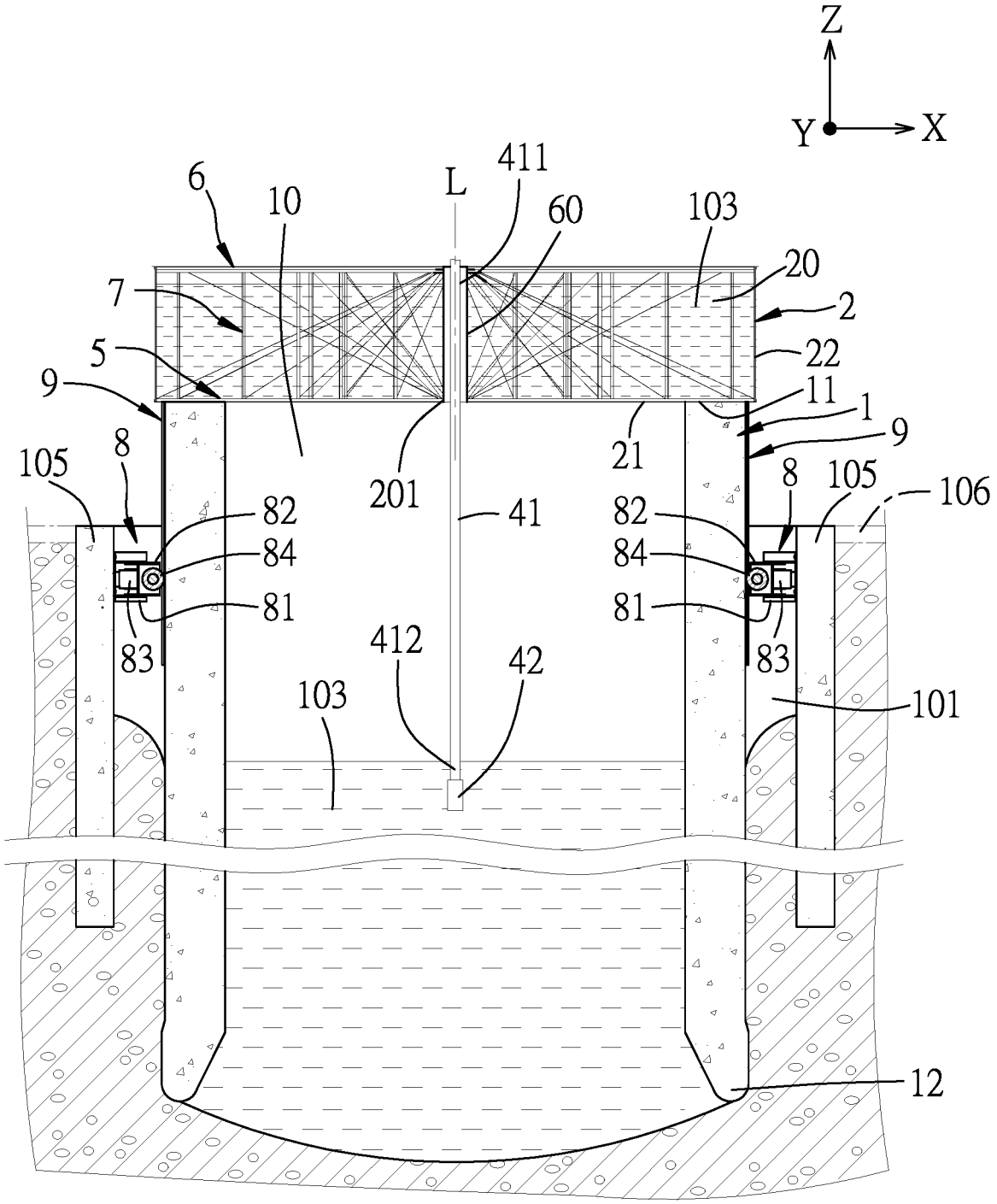
FIG. 10 is a schematic cross-sectional view illustrating a water tank of the sinking apparatus mounted on the concrete shaft and filled with water.

Referring to FIGS. 1 and 10, a sinking apparatus for sinking a concrete shaft 1 is shown to include a water tank 2, a valve assembly 3, a communication pipe 41, and a pumping device 42.

As shown in FIGS. 1, 2, 4, and 7, the water tank 2 is provided for being disposed on an upper surrounding edge 11 of the concrete shaft 1, and includes a base wall 21 and a surrounding wall 22. The base wall 21 has a water outlet port 202 and defines a central axis (L) in an upright direction (Z). The surrounding wall 22 extends upwardly from a periphery of the base wall 21 to define a water accommodation space 20.

In an embodiment shown in FIGS. 1 to 4, the base wall 21 is circular in shape, and may further have a central bore 201 along the central axis (L), and the water outlet port 202 is offset from the central bore 201.

Figure 7:
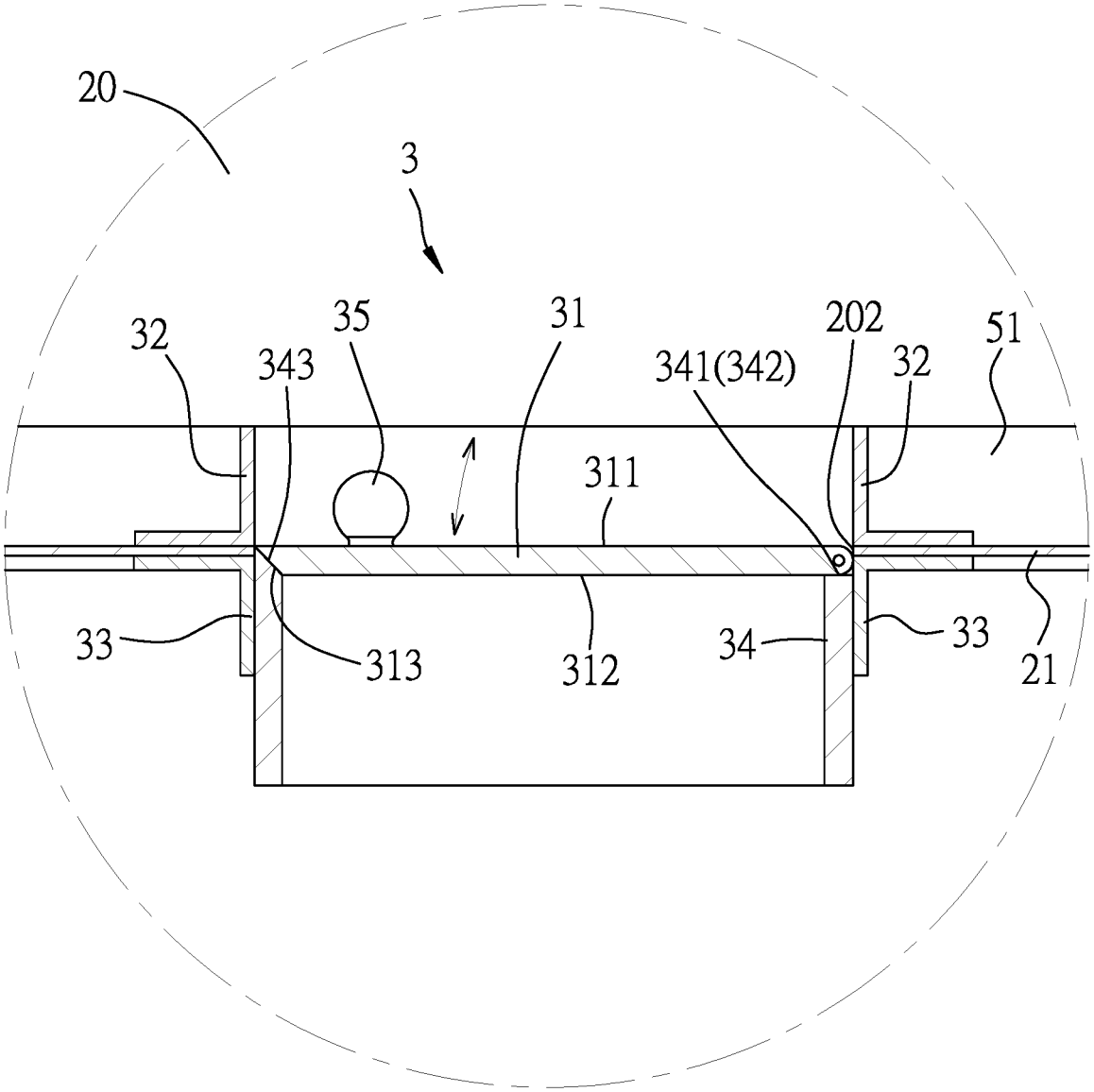
FIG. 7 is a fragmentary enlarged view of the detail enclosed in circle B of FIG. 4.

As shown in FIGS. 1 and 7, the valve assembly 3 is mounted to the base wall 21, and includes a valve gate 31 which is operable to open and close the water outlet port 202.

Figure 2:
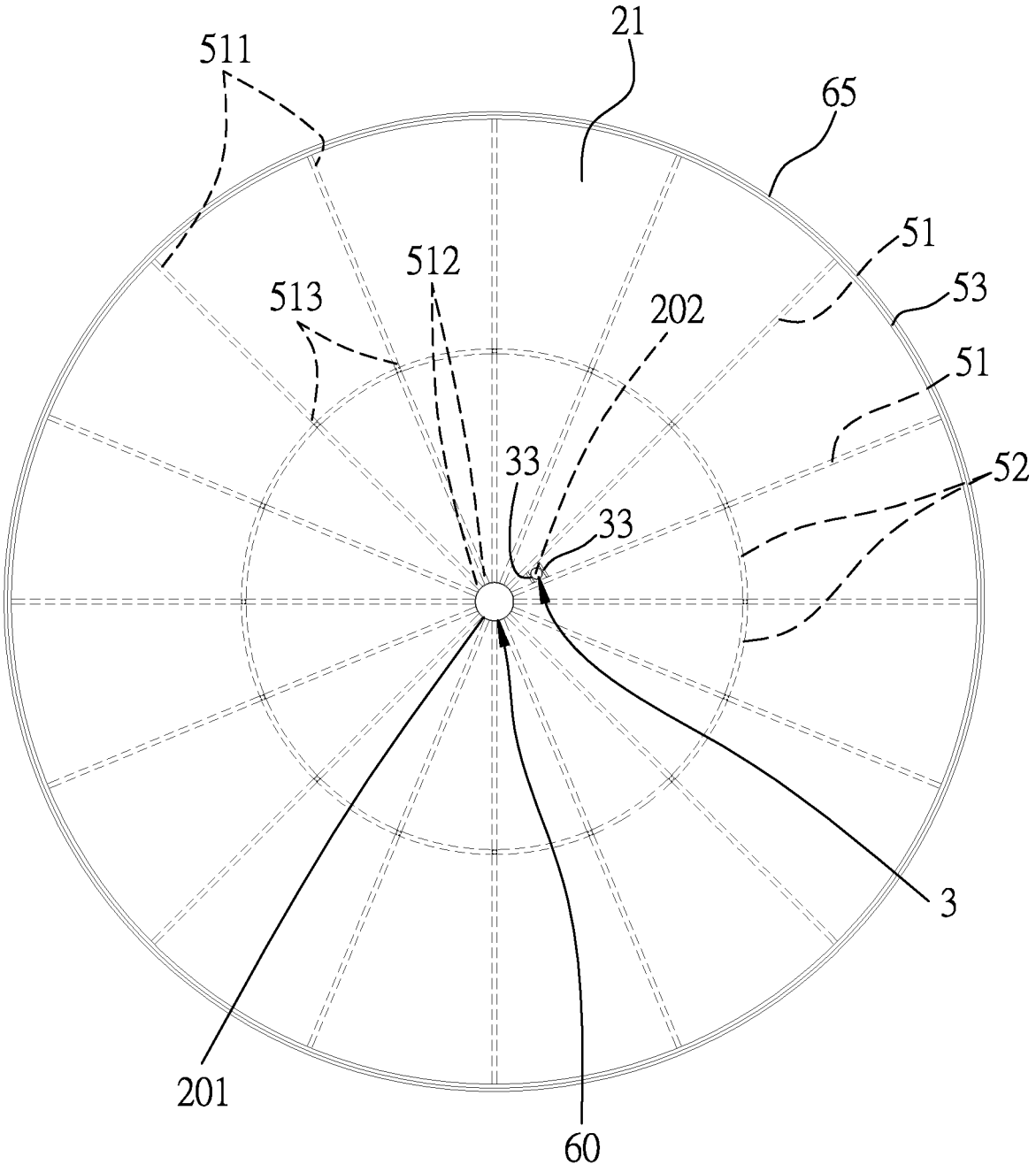
FIG. 2 is a schematic bottom view of the sinking apparatus shown in FIG.
Figure 3:
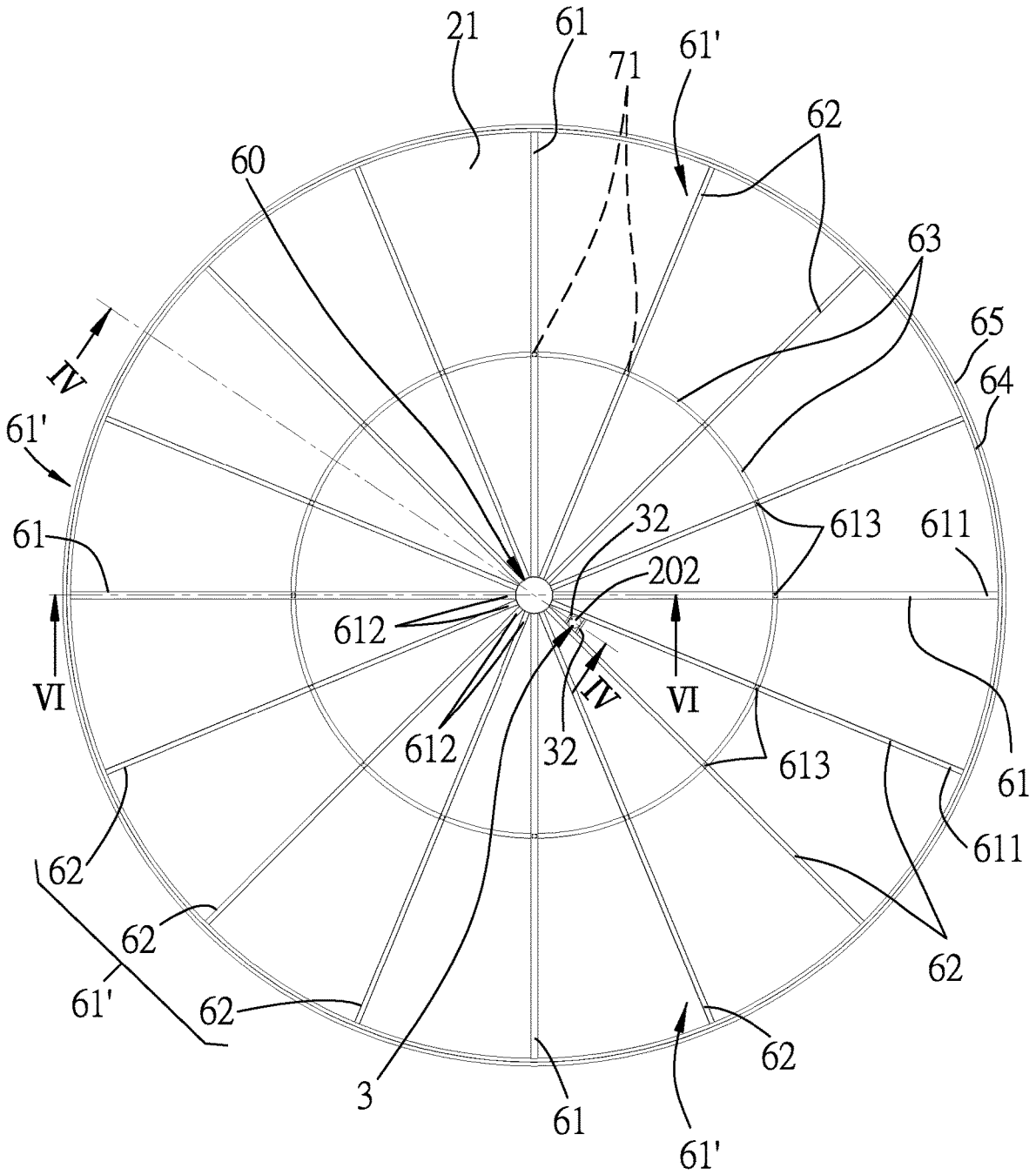
FIG. 3 is a schematic top view of the sinking apparatus shown in FIG.

In an embodiment shown in FIGS. 2, 3, and 7, the valve assembly 3 may further include two upper angle steel pieces 32, two lower angle steel pieces 33, and a tubular stem 34. The upper angle steel pieces 32 are mounted on an upper major surface of the base wall 21 at two opposite sides of the water outlet port 202. The lower angle steel pieces 33 are mounted on a lower major surface of the base wall 21 at two opposite sides of the water outlet port 202. The tubular stem 34 is mounted between the lower angle steel pieces 33 in fluid communication with the water outlet port 202, and has an upper surrounding edge 341 which includes a mounted area 342. The valve gate 31 is pivotally mounted to the mounted area 342 of the tubular stem 34 to be displaceable between an opened position (not shown) and a closed position (FIG. 7). In the opened position, the water accommodation space 20 is in fluid communication with the tubular stem 34 through the water outlet port 202. In the closed position, the valve gate 31 is sealingly fitted in the water outlet port 202 to block the fluid communication.

In certain embodiments, each of the upper angle steel pieces 32 and the lower angle steel pieces 33 is mounted to the base wall 21 by, for example, welding. The tubular stem 34 is mounted between the lower angle steel pieces 33 by, for example, welding.

In an embodiment shown in FIG. 7, the valve assembly 3 may further include a grip member 35 mounted on a distal major surface 311 of the valve gate 31 relative to the tubular stem 34 so as to permit displacement of the valve gate 31 from the closed position to the opened position when the grip member 35 is pulled upwardly.

In an embodiment shown in FIG. 7, the upper surrounding edge 341 of the tubular stem 34 may further include a beveled area 343, and the valve gate 31 has a proximate major surface 312 relative to the tubular stem 34. The proximate major surface 312 may have a beveled sealing edge 313 configured to be brought into sealing engagement with the beveled area 343 of the tubular stem 34 when the valve gate 31 is in the closed position.

The communication pipe 41 may have an upper segment 411 and a lower segment 412. The upper segment 411 is coupled to the water tank 2 to permit the communication pipe 41 to be in fluid communication with the water accommodation space 20. The lower segment 412 is provided for being disposed into a central hollow portion 10 of the concrete shaft 1.

The pumping device 42 is disposed to permit water 103 (see FIG. 10) inside the central hollow portion 10 of the concrete shaft 1 to be pumped into the water accommodation space 20 through the communication pipe 41. In an embodiment shown in FIG. 10, the water 103 is groundwater which may gush out when the soil or the like underneath the concrete shaft 1 is excavated through the central hollow portion 10 of the concrete shaft 1. In addition, the pumping device 42 is connected to the lower segment 412 for being disposed beneath the water level of the groundwater 103.

Figure 4:
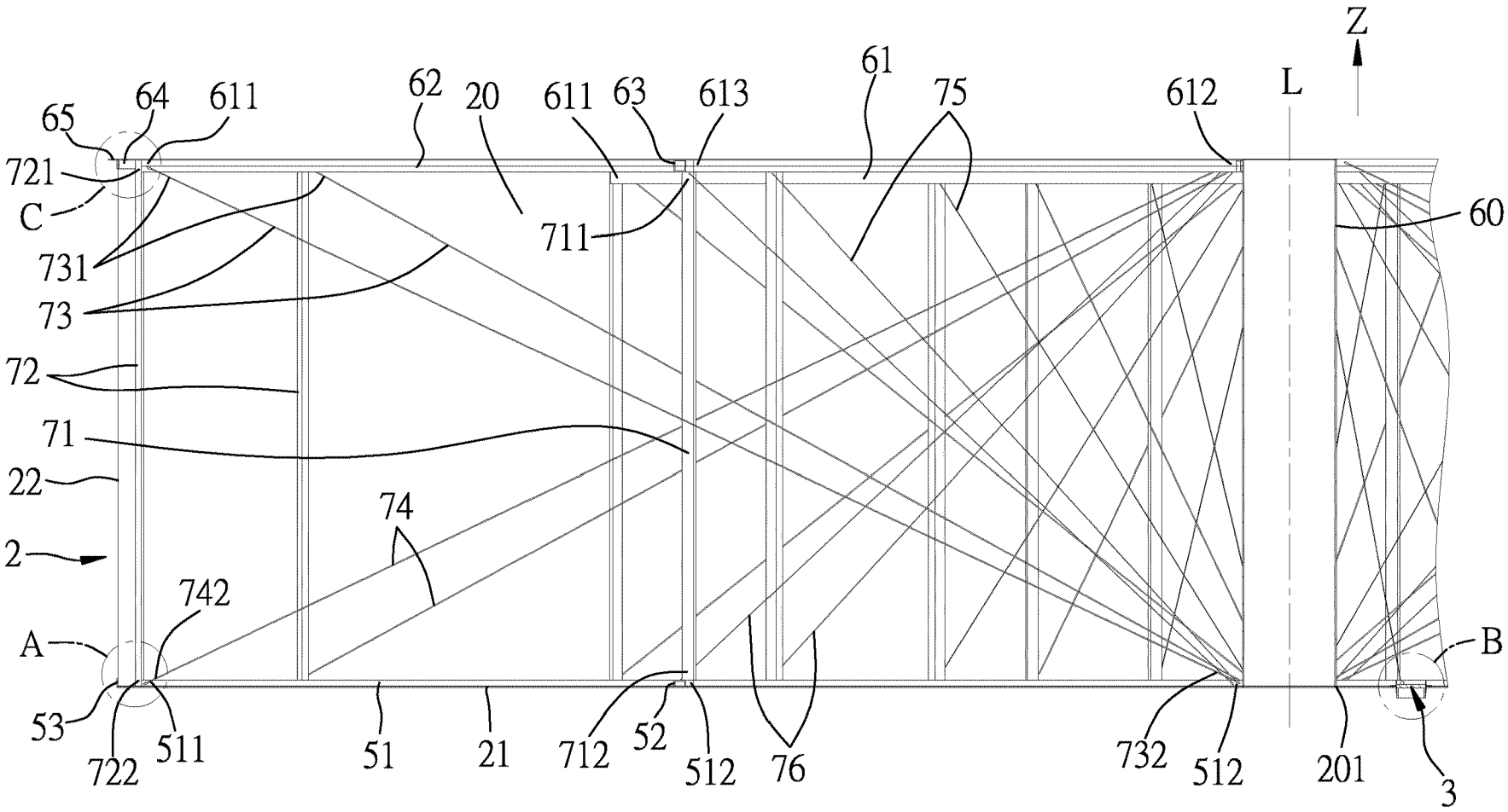
FIG. 4 is a fragmentary schematic cross-sectional view taken along line IV-IV of FIG. 3.
Figure 11:
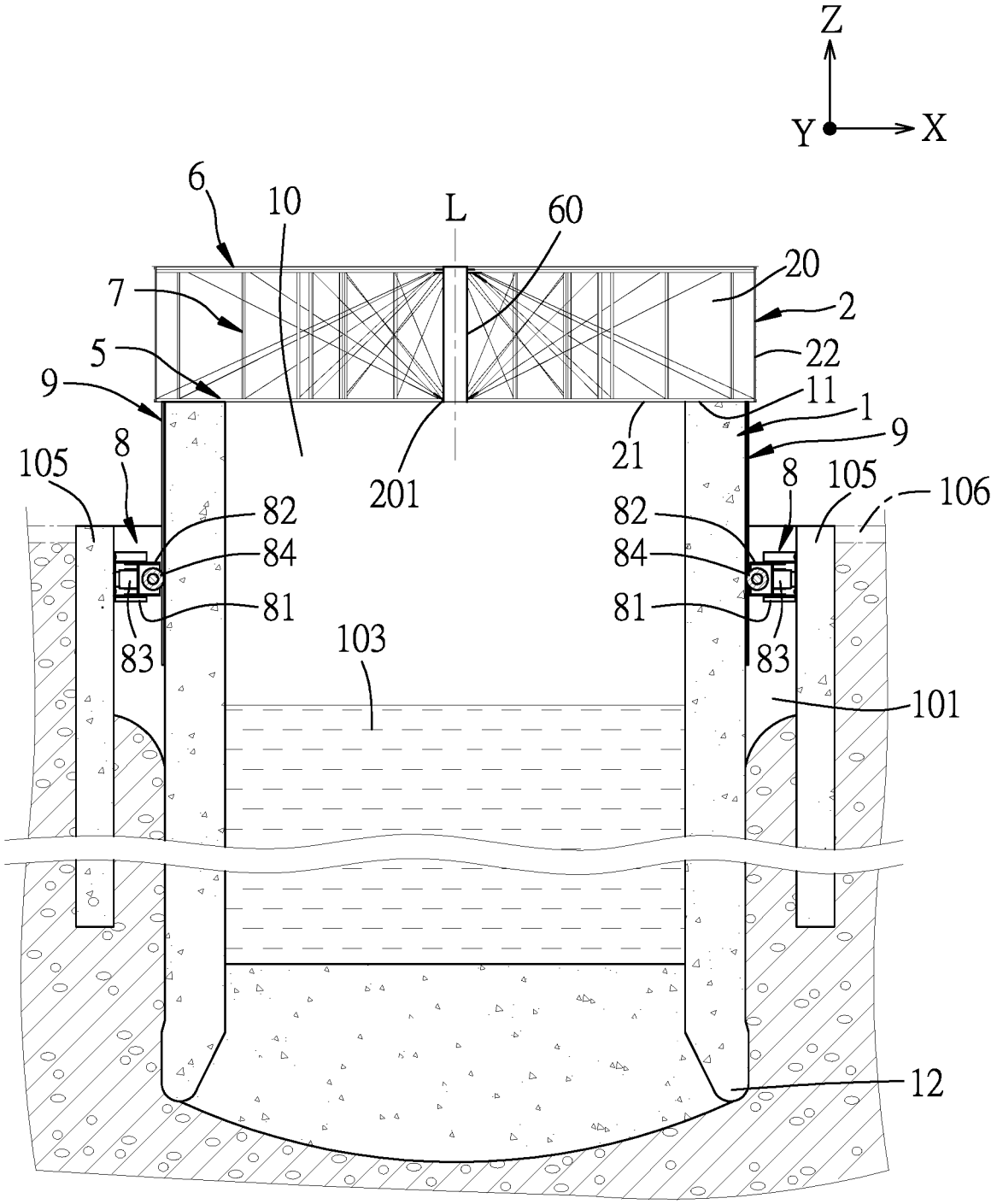
FIG. 11 is similar to FIG. 10 but illustrating a state where water inside the water tank is discharged back to a central hollow portion of the concrete shaft and where a communication pipe and a pumping device have been removed.

In an embodiment shown in FIGS. 1, 4, 10, and 11, the sinking apparatus may further include a steel tube 60 which extends along the central axis (L), and which is mounted on the base wall 21. As shown in FIGS. 4, 10 and 11, a lower end of the steel tube 60 may be sealingly fitted in the central bore 201, and the upper segment 411 of the communication pipe 41 extends upwardly through the steel tube 60, thereby permitting the communication pipe 41 to be in fluid communication with the water accommodation space 20.

In an embodiment shown in FIGS. 1 to 3, the sinking apparatus may further include a lower reinforcing structure 5 and an upper reinforcing structure 6. The lower reinforcing structure 5 is disposed in the water accommodation space 20, and is mounted to reinforce the base wall 21. The upper reinforcing structure 6 is disposed above the lower reinforcing structure 5, and is mounted to reinforce the surrounding wall 22.

In an embodiment shown in FIG. 2, the lower reinforcing structure 5 may include a plurality of lower steel beams 51 mounted on the upper major surface of the base wall 21, and equiangularly displaced from each other about the central axis (L) so as to reinforce the base wall 21. Each of the lower steel beams 51 extends lengthwise and has an outer lower beam end 511, an inner lower beam end 512, and a lower middle segment 513 between the outer lower beam end 511 and the inner lower beam end 512. Each of the lower steel beams 51 may be formed by welding two elongated steel bars each having a U-shaped cross-section (100 mm×50 mm) to have an elongated opening. The two elongated steel bars for forming each of the lower steel beams 51 may be welded together with the elongated openings thereof confronting each other.

In an embodiment shown in FIG. 2, the water outlet port 202 of the base wall 21 is located between two adjacent ones of the lower steel beams 51 in proximity to the steel tube 60.

In an embodiment shown in FIGS. 1 and 2, the lower reinforcing structure 5 may further include a plurality of lower arcuate steel beams 52 each interconnecting the lower middle segments 513 of two respective adjacent ones of the lower steel beams 51. The lower arcuate steel beams 52 may together define an annular line about the central axis (L). Each of the lower arcuate steel beams 52 may have a U-shaped cross-section (100 mm×50 mm).

Figure 5:
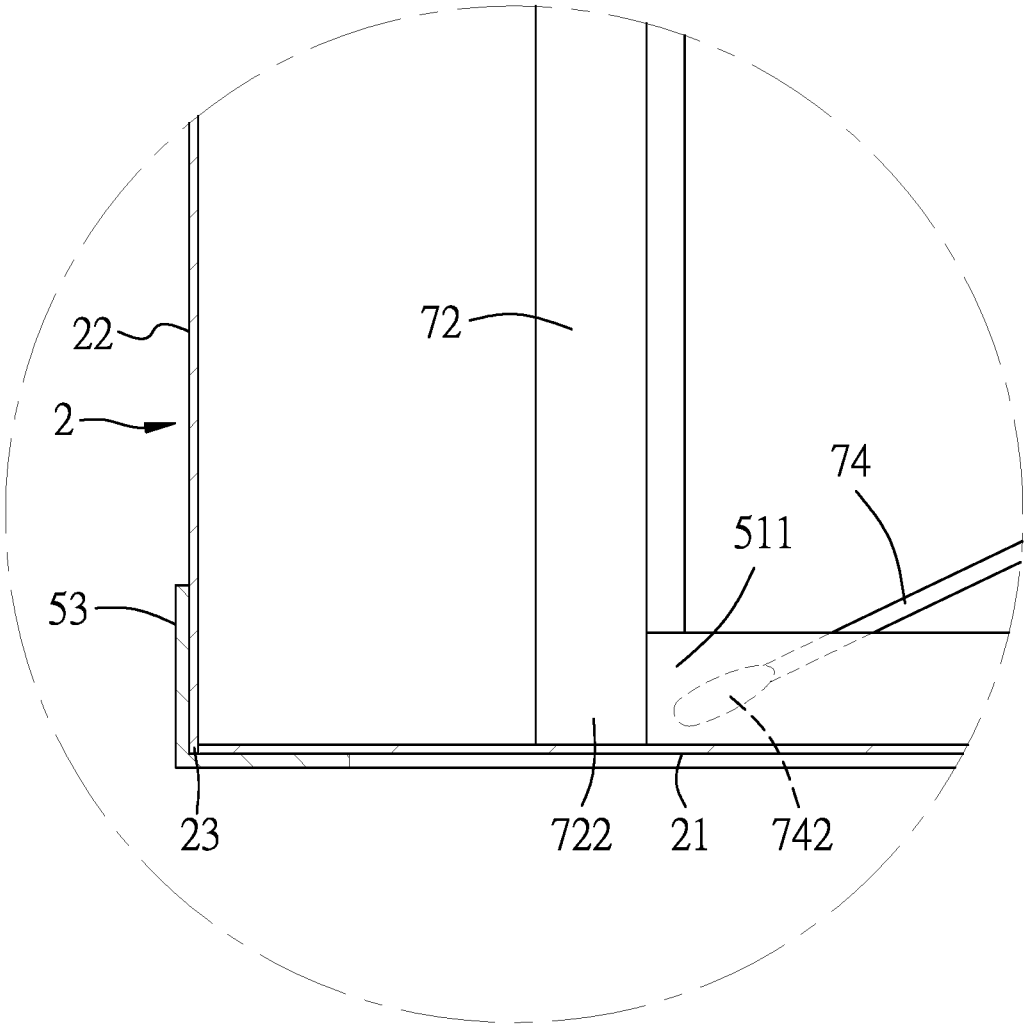
FIG. 5 is a fragmentary enlarged view of the detail enclosed in circle A of FIG. 4.
Figure 6:
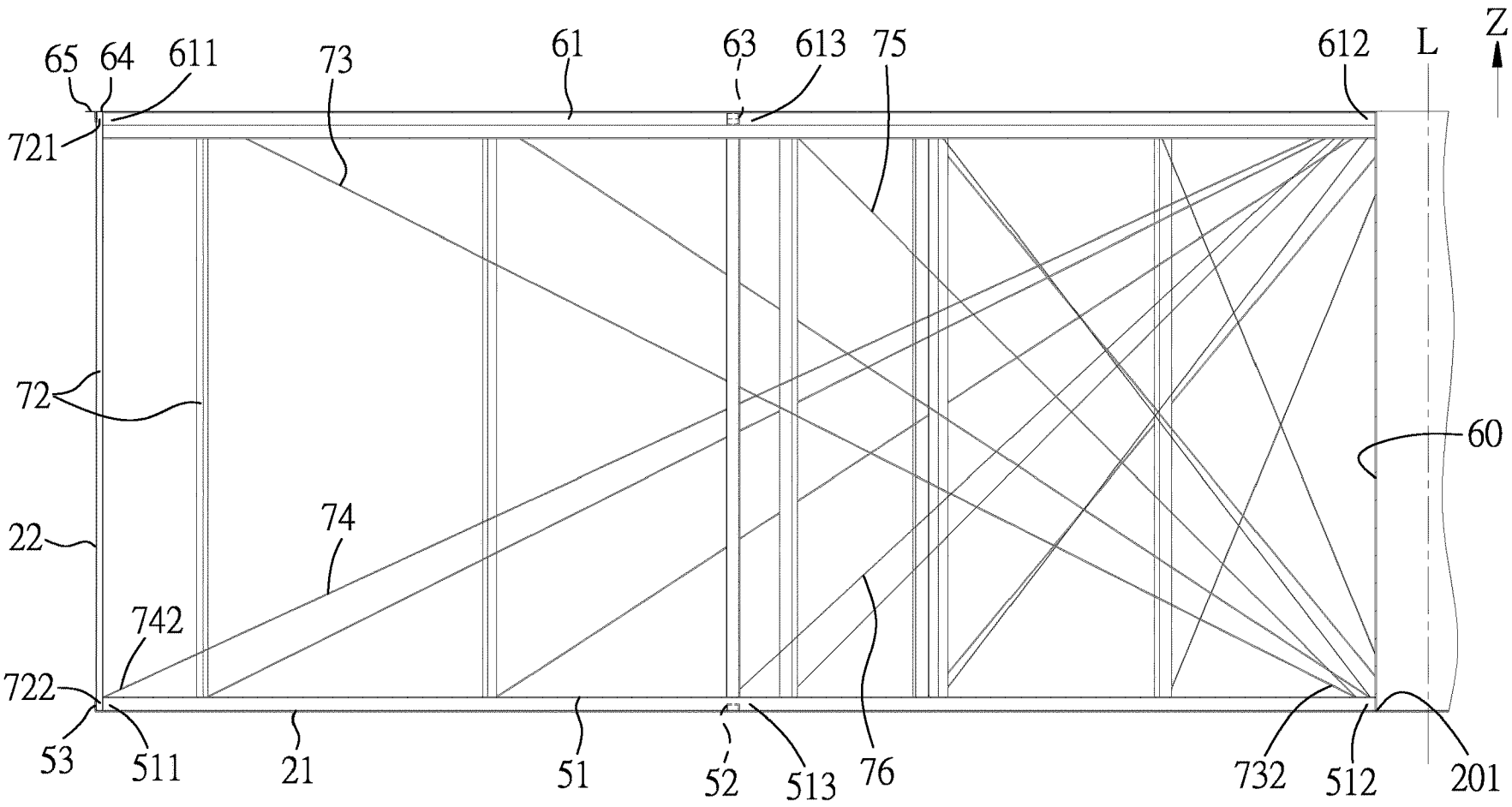
FIG. 6 is a fragmentary schematic cross-sectional view taken along line VI-VI of FIG. 3.

In an embodiment shown in FIGS. 2, 4, and 5, the lower reinforcing structure 5 may further include a lower outer angle steel 53 extending about the central axis (L), and mounted on an outer surface of a corner 23 defined between the base wall 21 and the surrounding wall 22. The lower outer angle steel 53 may have an L-shaped cross-section (see FIG. 5), and may extend about the central axis (L) to have a ring shape (see FIG. 2).

In certain embodiments, the elements of the lower reinforcing structure 5 may be connected to each other by, for example, welding, and the elements of the lower reinforcing structure 5 may be connected or mounted to the water tank 2 by, for example, welding.

As shown in FIGS. 1 and 3, the upper reinforcing structure 6 may include a plurality of first upper steel beams 61 and a plurality of upper steel units 61'. The first upper steel beams 61 are equiangularly displaced from each other about the central axis (L). Each of the upper steel units 61' is disposed between two respective adjacent ones of the first upper steel beams 61, and includes at least one second upper steel beam 62. Each of the first upper steel beams 61 and the second upper steel beams 62 of the upper steel units 61' extends lengthwise and has an outer upper beam end 611, an inner upper beam end 612, and an upper middle segment 613 between the outer upper beam end 611 and the inner upper beam end 612. The outer upper beam end 611 and the inner upper beam end 612 of each of the first upper steel beams 61 and the second upper steel beams 62 of the upper steel units 61' are respectively coupled to the surrounding wall 22 and the steel tube 60 such that the first upper steel beams 61 and the second upper steel beams 62 of the upper steel units 61' are equiangularly displaced from each other about the central axis (L), thereby reinforcing the surrounding wall 22.

In an embodiment shown in FIGS. 1 to 3, each of the first upper steel beams 61 and the second upper steel beams 62 of the upper steel units 61' is in alignment with a respective one of the lower steel beams 51 in the upright direction (Z).

In an embodiment shown in FIG. 3, each of the first upper steel beams 61 has a cross-sectional area larger than that of the at least one second upper steel beam 62. In details, each of the first upper steel beams 61 and the second upper steel beams 62 of the upper steel units 61' may be formed by welding two elongated steel bars together. Each of the elongated steel bars for forming the first upper steel beams 61 may have a U-shaped cross-section (150 mm×100 mm) to have an elongated opening, and each of the elongated steel bars for forming the second upper steel beams 62 may have a U-shaped cross-section (100 mm×50 mm) to have an elongated opening. The two elongated steel bars for forming each of the first and second upper steel beams 61, 62 may be welded together with the elongated openings thereof confronting each other.

In an embodiment shown in FIG. 3, the upper reinforcing structure 6 include four of the first upper steel beams 61 and four of the upper steel units 61'. The first upper steel beams 61 are angularly displaced from each other at 90 degree intervals. Each of the upper steel units 61' includes three of the second upper steel beams 62.

In an embodiment shown in FIGS. 1 and 3, the upper reinforcing structure 6 may further include a plurality of upper arcuate steel beams 63 each interconnecting the upper middle segments 613 of two respective adjacent ones of the first upper steel beams 61 and the second upper steel beams 62 of the upper steel units 61'. The upper arcuate steel beams 63 may together define an annular line about the central axis (L). Each of the upper arcuate steel beams 63 may have a U-shaped cross-section (100 mm×50 mm).

In an embodiment shown in FIGS. 1 to 3, each of the upper arcuate steel beams 63 is in alignment with a respective one of the lower arcuate steel beams 52 in the upright direction (Z).

Figure 8:
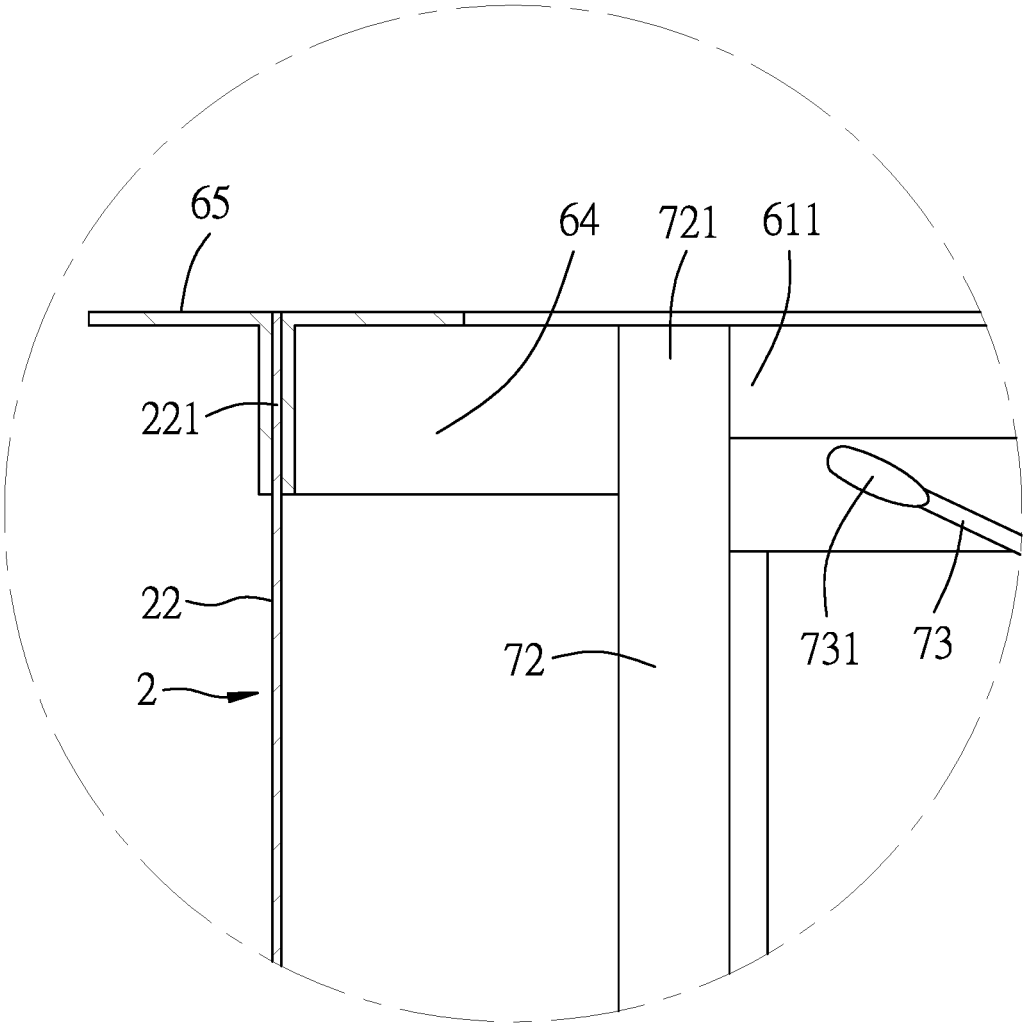
FIG. 8 is a fragmentary enlarged view of the detail enclosed in circle C of FIG. 4.

In an embodiment shown in FIGS. 3, 4, and 8, the upper reinforcing structure 6 may further include an upper inner angle steel 64 and an upper outer angle steel 65. The upper inner angle steel 64 extends about the central axis (L), and is mounted on an inner peripheral surface of an upper marginal portion 221 of the surrounding wall 22 so as to permit the outer upper beam ends 611 of the first upper steel beams 61 and the second upper steel beams 62 of the upper steel units 61' to be coupled to the surrounding wall 22 through the upper inner angle steel 64. The upper outer angle steel 65 extends about the central axis (L), and is mounted on an outer peripheral surface of the upper marginal portion 221 of the surrounding wall 22 such that the upper marginal portion 221 of the surrounding wall 22 is sandwiched between the upper inner angle steel 64 and the upper outer angle steel 65. Each of the upper inner angle steel 64 and the upper outer angle steel 65 may have an L-shaped cross-section (see FIG. B), and may extend about the central axis (L) to have a ring shape (see FIG. 3).

In certain embodiments, the elements of the upper reinforcing structure 6 may be connected to each other by, for example, welding, and the elements of the upper reinforcing structure 6 may be connected or mounted to the water tank 2 by, for example, welding.

Figure 9:
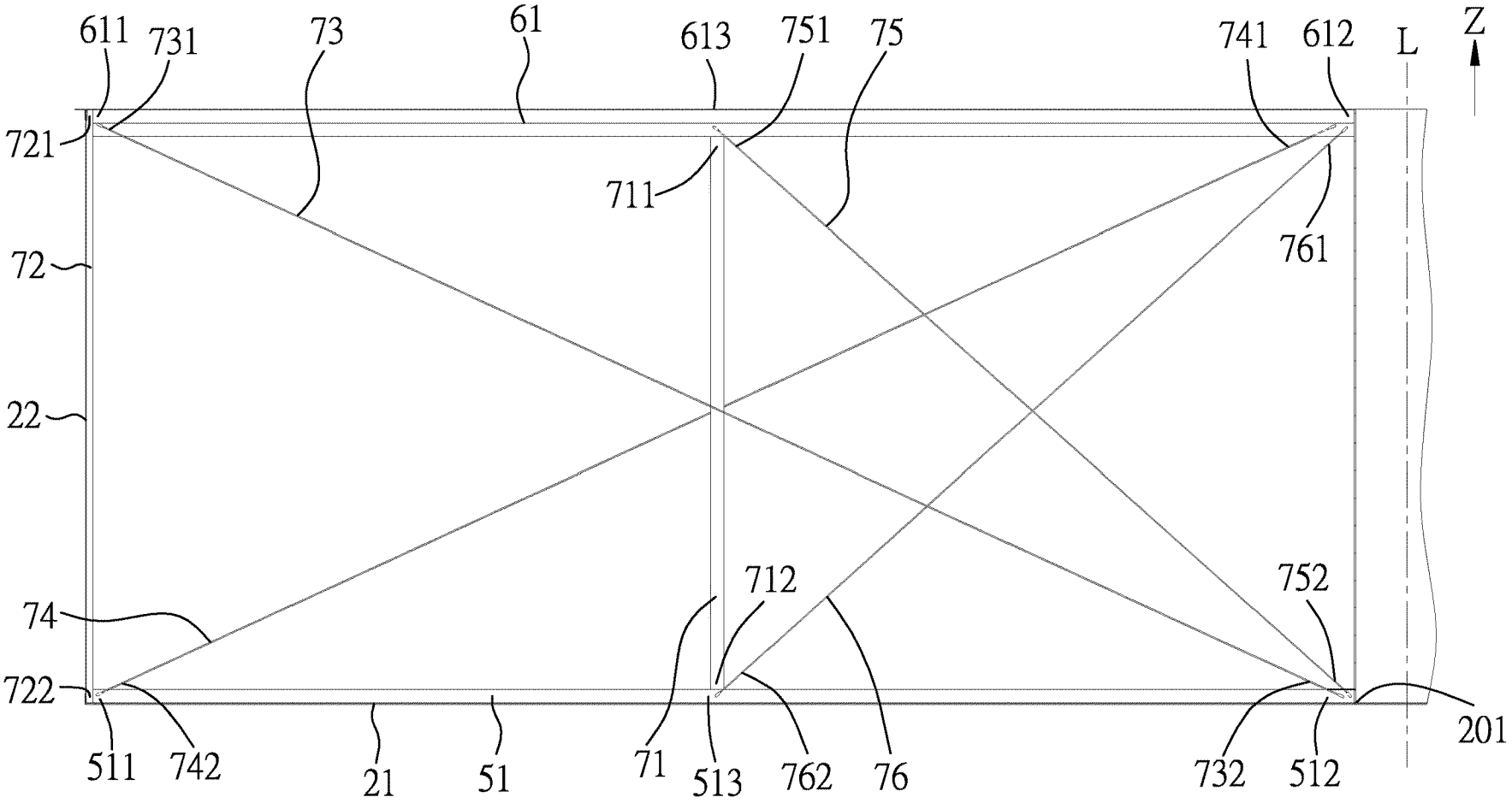
FIG. 9 is similar to FIG. 4 but omitting some elements for better illustrating first, second, third, fourth, fifth, and sixth reinforcing bars.

In an embodiment shown in FIGS. 1, 4, and 9, the sinking apparatus may further include a reinforcing unit 7 which includes a plurality of first reinforcing bars 71. Each of the first reinforcing bars 71 extends in the upright direction (Z), and has a first upper end 711 and a first lower end 712. The first upper end 711 is connected to the upper middle segment 613 of a respective one of the first upper steel beams 61 and the second upper steel beams 62 of the upper steel units 61', and is located between two respective adjacent ones of the upper arcuate steel beams 63. The first lower end 712 is connected to the lower middle segment 513 of a respective one of the lower steel beams 51, and is located between two respective adjacent ones of the lower arcuate steel beams 52.

In an embodiment shown in FIGS. 1, 4, and 9, the reinforcing unit 7 may further include a plurality of second reinforcing bars 72. Each of the second reinforcing bars 72 extends in the upright direction (Z), and has a second upper end 721 and a second lower end 722. The second upper end 721 is connected to the outer upper beam end 611 of a respective one of the first upper steel beams 61 and the second upper steel beams 62 of the upper steel units 61'. The second lower end 722 is connected to the outer lower beam end 511 of a respective one of the lower steel beams 51.

In an embodiment shown in FIGS. 1, 4, and 9, the reinforcing unit 7 may further include a plurality of third reinforcing bars 73. Each of the third reinforcing bars 73 has a third upper end 731 and a third lower end 732. The third upper end 731 is connected to the outer upper beam end 611 of a respective one of the first upper steel beams 61 and the second upper steel beams 62 of the upper steel units 61'. The third lower end 732 is connected to the inner lower beam end 512 of a respective one of the lower steel beams 51.

In an embodiment shown in FIGS. 1, 4, and 9, the reinforcing unit 7 may further include a plurality of fourth reinforcing bars 74. Each of the fourth reinforcing bars 74 has a fourth upper end 741 and a fourth lower end 742. The fourth upper end 741 is connected to the inner upper beam end 612 of a respective one of the first upper steel beams 61 and the second upper steel beams 62 of the upper steel units 61'. The fourth lower end 742 is connected to the outer lower beam end 511 of a respective one of the lower steel beams 51.

In an embodiment shown in FIGS. 1, 4, and 9, the reinforcing unit 7 may further include a plurality of fifth reinforcing bars 75. Each of fifth reinforcing bars 75 has a fifth upper end 751 and a fifth lower end 752. The fifth upper end 751 is connected to the upper middle segment 613 of a respective one of the first upper steel beams 61 and the second upper steel beams 62 of the upper steel units 61', and is located between two respective adjacent ones of the upper arcuate steel beams 63. The fifth lower end 752 is connected to the inner lower beam end 512 of a respective one of the lower steel beams 51.

In an embodiment shown in FIGS. 1, 4, and 9, the reinforcing unit 7 may further include a plurality of sixth reinforcing bars 76. Each of the sixth reinforcing bars 76 has a sixth upper end 761 and a sixth lower end 762. The sixth upper end 761 is connected to the inner upper beam end 612 of a respective one of the first upper steel beams 61 and the second upper steel beams 62 of the upper steel units 61'. The sixth lower end 762 is connected to the lower middle segment 513 of a respective one of the lower steel beams 51, and is located between two respective adjacent ones of the lower arcuate steel beams 52.

In certain embodiments, the elements of the reinforcing unit 7 may be connected to the lower and upper reinforcing structures 5, 6 by, for example, welding.

With the provision of the lower reinforcing structure 5, the upper reinforcing structure 6, and/or the reinforcing unit 7, the water tank 2, when being loaded with a large amount of water, is less likely to collapse due to the weight of the water.

As shown in FIG. 10, the concrete shaft 1 may be disposed in a pit 101 which is located at an area for sinking the concrete shaft 1. The pit 101 may be made by excavating about 2 to 3 meters under the ground, followed by forming two first concrete walls 105 which are opposite to each other in a front-rear direction (X) and two second concrete walls (not shown) which are opposite to each other in a left-right direction (Y). Top surfaces of the first concrete walls 105 and the second concrete walls are co-planar with a concrete plate which is provided on the ground to serve as the working platform 106.

For sinking the concrete shaft 1 smoothly, four guided rails 9 (only two are shown) may be provided on an outer peripheral surface of the concrete shaft 1, and four guiding units 8 are respectively provided on the first concrete walls 105 and the second concrete walls. Each of the guiding units 8 includes a base mount 81, a movable retainer 82, a jack member 83, and a guide roller 84. The base mount 81 of each of the guiding units 8 is mounted on a respective one of the first concrete walls 105 and the second concrete walls. The movable retainer 82 is slidably retained by the base mount 81. The lack member 83 is disposed between the movable retainer 82 and the base mount 81. The guide roller 84 is retained by the movable retainer 82. After the concrete shaft 1 is disposed in the pit 101, the jack member 83 of each of the guiding unit 8 is driven to move the guide roller 84 into rolling contact with a respective one of guided rails 9. With the provision of the guiding units 8 and the guided rails 9, a lower surrounding edge 12 of the concrete shaft 1 may be evenly sunk into a bottom surface of the pit 101 in the upright direction (Z).

The concrete shaft 1 may be sunk using any conventional method or apparatus. Each time after the concrete shaft 1 is sunk a predetermined distance, the soil or the like beneath the concrete shaft 1 is further excavated out through the central hollow portion 10 of the concrete shaft 1.

After the concrete shaft 1 was sunk to a certain depth, the groundwater 103 may gush out. After the sinking apparatus of the disclosure is mounted on the upper surrounding edge 11 of the concrete shaft 1, the pumping device 42 (such as a water pumping motor) is disposed beneath the water level of the groundwater 103 for pumping the groundwater 103 to the water accommodation space 20 through the communication pipe 41. The concrete shaft 1, which is pressed by the sinking apparatus loaded with the groundwater 103 (see FIG. 10), may be further sunk into the bottom surface of the pit 101. After the concrete shaft 1 is sunk to a predetermined depth, the groundwater 103 inside central hollow portion 10 of the concrete shaft 1 is fully drawn out of the central hollow portion 10 of the concrete shaft 1 to permit a concrete material to be poured into and cured in the central hollow portion 10 of the concrete shaft 1 (see FIG. 11). Then, by displacement of the valve gate 31 from the closed position to the opened position, the groundwater 103 in the water accommodation space 20 may be discharged back to the central hollow portion 10 of the concrete shaft 1 through the water outlet port 202 (see FIGS. 7 and 11).

In sum, with the provision of the sinking apparatus of the disclosure, the groundwater 103, which may gush out during sinking of the concrete shaft 1, may be utilized for further sinking of the concrete shaft 1.

In the description above, for the purposes of explanation, numerous specific details have been set forth in order to provide a thorough understanding of the embodiment (s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment (s) it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A sinking apparatus for sinking a concrete shaft, comprising:

a water tank for being disposed on an upper surrounding edge of the concrete shaft, and including a base wall having a water outlet port, and defining a central axis in an upright direction, and a surrounding wall which extends upwardly from a periphery of said base wall to define a water accommodation space;

a valve assembly mounted to said base wall, and including a valve gate which is operable to open and close said water outlet port;

a communication pipe having an upper segment coupled to said water tank to permit said communication pipe to be in fluid communication with said water accommodation space, and a lower segment for being disposed into a central hollow portion of the concrete shaft; and a pumping device disposed to permit water inside the central hollow portion of the concrete shaft to be pumped into said water accommodation space through said communication pipe.

2. The sinking apparatus according to claim 1, further comprising a steel tube which extends along the central axis, and which is mounted on said base wall.

3. The sinking apparatus according to claim 2, wherein said base wall further has a central bore which extends along the central axis, and which is configured to permit a lower end of said steel tube to be sealingly fitted therein; and wherein said upper segment of said communication pipe extends upwardly through said steel tube, thereby permitting said communication pipe to be in fluid communication with said water accommodation space.

4. The sinking apparatus according to claim 2, further comprising:

a lower reinforcing structure disposed in said water accommodation space, and mounted to reinforce said base wall; and an upper reinforcing structure disposed above said lower reinforcing structure, and mounted to reinforce said surrounding wall.

5. The sinking apparatus according to claim 4, wherein said lower reinforcing structure includes a plurality of lower steel beams mounted on an upper major surface of said base wall, and equiangularly displaced from each other about the central axis so as to reinforce said base wall, each of said lower steel beams extending lengthwise and having an outer lower beam end, an inner lower beam end, and a lower middle segment between said outer lower beam end and said inner lower beam end; and wherein said upper reinforcing structure includes a plurality of first upper steel beams which equiangularly displaced from each other about the central axis, and a plurality of upper steel units each of which is disposed between two respective adjacent ones of said first upper steel beams, and each of which includes at least one second upper steel beam, each of said first upper steel beams and said second upper steel beams of said upper steel units extending lengthwise and having an outer upper beam end, an inner upper beam end, and an upper middle segment between said outer upper beam end and said inner upper beam end, said outer upper beam end and said inner upper beam end of each of said first upper steel beams and said second upper steel beams of said upper steel units being respectively coupled to said surrounding wall and said steel tube such that said first upper steel beams and said second upper steel beams of said upper steel units are equiangularly displaced from each other about the central axis, thereby reinforcing said surrounding wall.

6. The sinking apparatus according to claim 5, wherein said lower reinforcing structure further includes a plurality of lower arcuate steel beams each interconnecting said lower middle segments of two respective adjacent ones of said lower steel beams; and wherein said upper reinforcing structure further includes a plurality of upper arcuate steel beams each interconnecting said upper middle segments of two respective adjacent ones of said first upper steel beams and said second upper steel beams of said upper steel units.

7. The sinking apparatus according to claim 6, wherein each of said first upper steel beams and said second upper steel beams of said upper steel units is in alignment with a respective one of said lower steel beams in the upright direction, and each of said upper arcuate steel beams is in alignment with a respective one of said lower arcuate steel beams in the upright direction.

8. The sinking apparatus according to claim 7, further comprising a plurality of first reinforcing bars each extending in the upright direction, and each having a first upper end which is connected to said upper middle segment of a respective one of said first upper steel beams and said second upper steel beams of said upper steel units, and which is located between two respective adjacent ones of said upper arcuate steel beams, and a first lower end which is connected to said lower middle segment of a respective one of said lower steel beams, and which is located between two respective adjacent ones of said lower arcuate steel beams.

9. The sinking apparatus according to claim 8, further comprising a plurality of second reinforcing bars each extending in the upright direction, and each having a second upper end connected to said outer upper beam end of a respective one of said first upper steel beams and said second upper steel beams of said upper steel units, and a second lower end connected to said outer lower beam end of a respective one of said lower steel beams.

10. The sinking apparatus according to claim 9, further comprising a plurality of third reinforcing bars each having a third upper end connected to said outer upper beam end of a respective one of said first upper steel beams and said second upper steel beams of said upper steel units, and a third lower end connected to said inner lower beam end of a respective one of said lower steel beams.

11. The sinking apparatus according to claim 10, further comprising a plurality of fourth reinforcing bars each having a fourth upper end connected to said inner upper beam end of a respective one of said first upper steel beams and said second upper steel beams of said upper steel units, and a fourth lower end connected to said outer lower beam end of a respective one of said lower steel beams.

12. The sinking apparatus according to claim 11, further comprising a plurality of fifth reinforcing bars each having a fifth upper end which is connected to said upper middle segment of a respective one of said first upper steel beams and said second upper steel beams of said upper steel units, and which is located between two respective adjacent ones of said upper arcuate steel beams, and a fifth lower end connected to said inner lower beam end of a respective one of said lower steel beams.

13. The sinking apparatus according to claim 12, further comprising a plurality of sixth reinforcing bars each having a sixth upper end connected to said inner upper beam end of a respective one of said first upper steel beams and said second upper steel beams of said upper steel units, and a sixth lower end which is connected to said lower middle segment of a respective one of said lower steel beams, and which is located between two respective adjacent ones of said lower arcuate steel beams.

14. The sinking apparatus according to claim 5, wherein each of said first upper steel beams has a cross-sectional area larger than that of said at least one second upper steel beam.

15. The sinking apparatus according to claim 5, wherein said lower reinforcing structure further includes a lower outer angle steel extending about the central axis, and mounted on an outer surface of a corner defined between said base wall and said surrounding wall; and wherein said upper reinforcing structure further includes an upper inner angle steel extending about the central axis, and mounted on an inner peripheral surface of an upper marginal portion of said surrounding wall so as to permit said outer upper beam ends of said first upper steel beams and said second upper steel beams of said upper steel units to be coupled to said surrounding wall through said upper inner angle steel, and an upper outer angle steel extending about the central axis, and mounted on an outer peripheral surface of said upper marginal portion of said surrounding wall such that said upper marginal portion of said surrounding wall is sandwiched between said upper inner angle steel and said upper outer angle steel.

16. The sinking apparatus according to claim 5, wherein said water outlet port of said base wall is located between two adjacent ones of said lower steel beams in proximity to said steel tube;

wherein said valve assembly further includes two upper angle steel pieces mounted on said upper major surface of said base wall at two opposite sides of said water outlet port, two lower angle steel pieces mounted on a lower major surface of said base wall at two opposite sides of said water outlet port, and a tubular stem mounted between said lower angle steel pieces in fluid communication with said water outlet port, said tubular stem having an upper surrounding edge which includes a mounted area; and wherein said valve gate is pivotally mounted to said mounted area of said tubular stem to be displaceable between an opened position, where said water accommodation space is in fluid communication with said tubular stem through said water outlet port, and a closed position, where said valve gate is sealingly fitted in said water outlet port to block the fluid communication.

17. The sinking apparatus according to claim 16, wherein said valve assembly further includes a grip member mounted on a distal major surface of said valve gate relative to said tubular stem so as to permit displacement of said valve gate from the closed position to the opened position when said grip member is pulled.

18. The sinking apparatus according to claim 16, wherein said upper surrounding edge of said tubular stem further includes a beveled area, and said valve gate has a proximate major surface relative to said tubular stem, said proximate major surface having a beveled sealing edge configured to be brought into sealing engagement with said beveled area of said tubular stem when said valve gate is in the closed position.

* * * * *